US011020866B2

(12) United States Patent
Murgida

(10) Patent No.: US 11,020,866 B2
(45) Date of Patent: Jun. 1, 2021

(54) HANDLE FOR A RAZOR

(71) Applicant: The Gillette Company LLC, Boston, MA (US)

(72) Inventor: Matthew Frank Murgida, Somerville, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/355,667

(22) Filed: Mar. 15, 2019

(65) Prior Publication Data

US 2020/0290224 A1 Sep. 17, 2020

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01); *B26B 21/522* (2013.01); *B26B 21/528* (2013.01)

(58) Field of Classification Search
CPC ..... B26B 21/521; B26B 21/25; B26B 21/522; B26B 21/528
See application file for complete search history.

(56) References Cited

U.S. PATENT DOCUMENTS 4,573,266 A * 3/1986 Jacobson ..... B26B 21/227 30/41
6,588,113 B2 * 7/2003 Bozikis ..... B26B 21/52 16/430
7,685,720 B2 * 3/2010 Efthimiadis ..... B26B 21/38 30/527
7,814,661 B2 * 10/2010 Tomassetti ..... A45D 27/28 30/41
8,037,608 B2 * 10/2011 Schnak ..... B26B 21/38 30/45
8,984,700 B2 * 3/2015 Pennell ..... B26B 21/522 15/143.1
9,913,386 B2 * 3/2018 Behrendt ..... H05K 5/0026
10,226,874 B2 * 3/2019 Lu ..... B26B 21/528
10,427,312 B2 * 10/2019 Gratsias ..... B26B 21/521
10,431,915 B2 * 10/2019 Broemse ..... A46B 15/0022
10,576,648 B2 * 3/2020 Efthimiadis ..... B26B 21/521
2007/0050997 A1 * 3/2007 Schnak ..... B26B 21/38 30/526
2007/0214662 A1 * 9/2007 Efthimiadis ..... B26B 21/521 30/527

(Continued)

*Primary Examiner* — Omar Flores Sanchez
(74) *Attorney, Agent, or Firm* — Joanne N. Pappas; Kevin C. Johnson

(57) ABSTRACT

A shaving razor handle comprising a body defined by a top shell joined to a bottom shell and comprising an open end, in which the top shell or the bottom shell comprises a substantially continuous band of material that forms the open end of the body. Also provided is a shaving razor handle with these features and a forward assembly coupled to the body, in which at least a portion of the forward assembly rotates relative to the body. Further provided is a shaving razor handle with these features, in which an inner edge of the one of the top shell or the bottom shell comprises a substantially linear portion extending substantially parallel to a longitudinal axis of the body and a curved portion extending between the substantially linear portion and the substantially continuous band of material.

20 Claims, 9 Drawing Sheets

(56) References Cited

U.S. PATENT DOCUMENTS

| | | | | |
|---|---|---|---|---|
| 2009/0113730 | A1* | 5/2009 | Psimadas | B26B 21/522 30/526 |
| 2009/0235530 | A1* | 9/2009 | Tomassetti | B26B 21/52 30/41.5 |
| 2009/0293292 | A1* | 12/2009 | Ramm | B26B 21/528 30/526 |
| 2011/0023310 | A1* | 2/2011 | Psimadas | B26B 21/4012 30/526 |
| 2013/0145601 | A1* | 6/2013 | Burrowes | B26B 21/528 29/453 |
| 2013/0220087 | A1* | 8/2013 | Pennell | B26B 21/522 81/489 |
| 2015/0266191 | A1* | 9/2015 | Maimone | B26B 21/52 30/527 |
| 2017/0334083 | A1* | 11/2017 | Gratsias | B26B 21/225 |
| 2018/0043553 | A1* | 2/2018 | Lu | B26B 21/522 |
| 2018/0043558 | A1* | 2/2018 | Lu | B26B 21/522 |
| 2018/0043560 | A1* | 2/2018 | Lu | B26B 21/521 |
| 2018/0168052 | A1* | 6/2018 | Behrendt | H05K 5/0026 |
| 2019/0061186 | A1* | 2/2019 | Efthimiadis | B26B 21/521 |
| 2019/0299471 | A1* | 10/2019 | Verasamy | B26B 21/521 |
| 2019/0299474 | A1* | 10/2019 | Bourque | B26B 21/521 |
| 2020/0016782 | A1* | 1/2020 | Robertson | B26B 21/4062 |
| 2020/0023532 | A1* | 1/2020 | Gratsias | B26B 21/225 |
| 2020/0223082 | A1* | 7/2020 | Robertson | B26B 21/4062 |

* cited by examiner

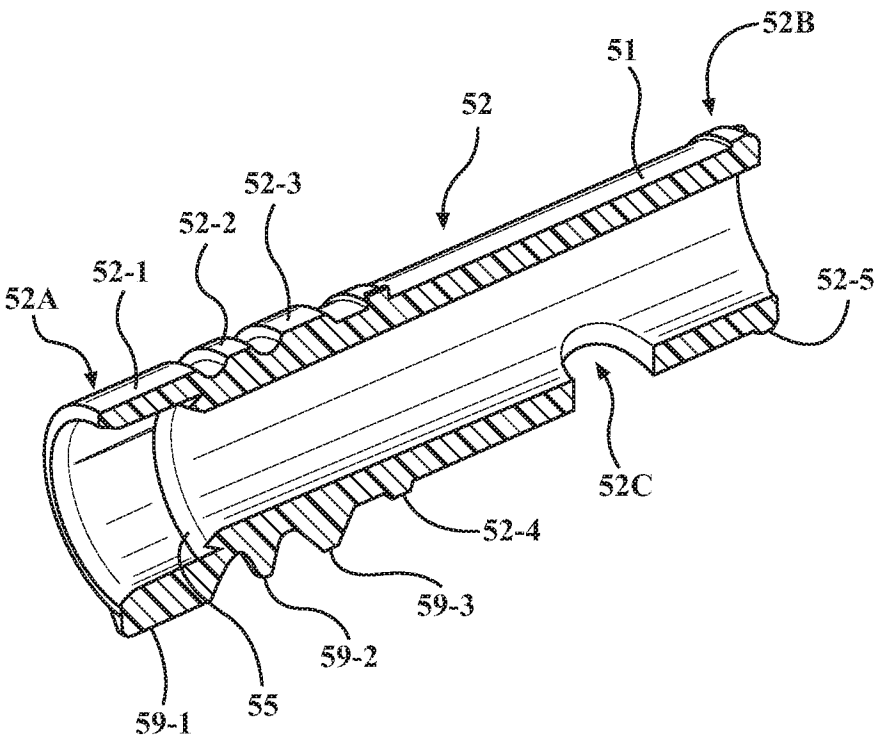
FIG. 10
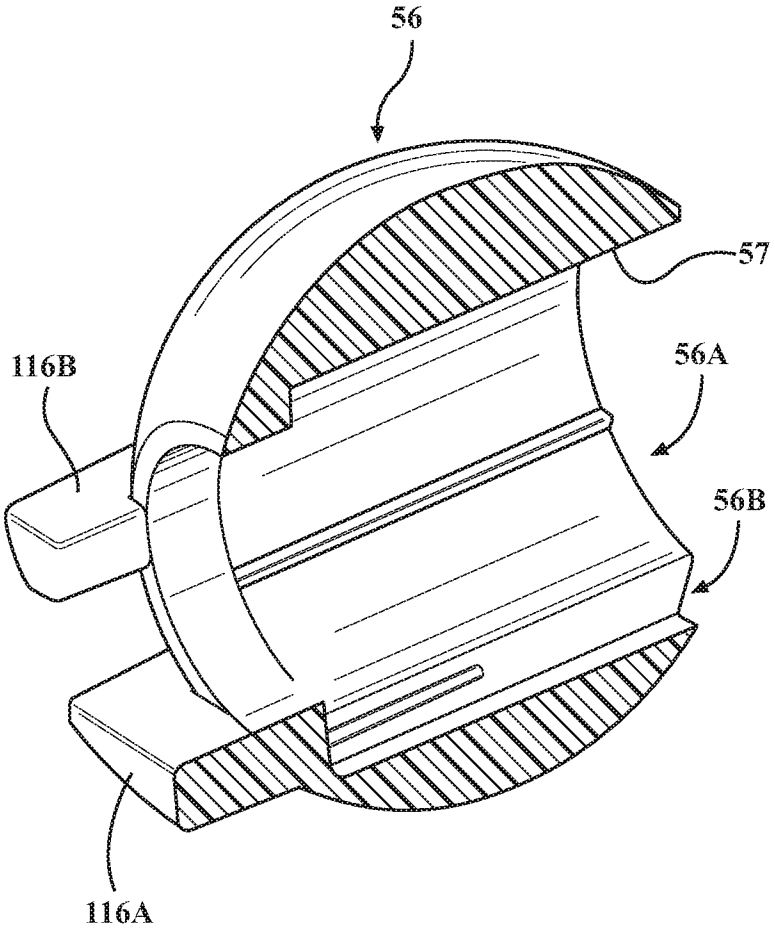

HANDLE FOR A RAZOR

FIELD OF THE INVENTION

The invention generally relates to shaving razor handles and systems, and more particularly to razor handles with increased bending strength.

BACKGROUND OF THE INVENTION

The shaving razor category has many different razor configurations, including razors that are "system" razors that have handles with replaceable cartridges, and disposable razors where the handle and cartridge are used together and thrown out after a time. Razors vary based on many attributes such as number of blades, cartridge shape, chemistry features on the cartridge and so forth.

In some shaving systems, the blades are resiliently mounted with respect to the cartridge housing and deflect under the force of skin contact during shaving. Connection of the cartridge to the handle may provide a pivotal mounting of the cartridge with respect to the handle (i.e., a front-to-back pivoting motion) so that the cartridge angle adjusts to follow the contours of the surface being shaved. In such systems, the cartridge may be biased toward an at-rest or home position by the action of a spring-biased plunger (a cam follower) carried on the handle against a cam surface on the cartridge housing.

Many razor handles are made from two separate components comprising, for example, a thermoplastic polymer, that are joined together via ultrasonic welding, adhesive, and/or other suitable methods. These razor handles are subjected to a variety of forces including impact and bending forces, such as during shaving and cartridge replacement when one end of the handle is held rigid and the other end is placed under a load. Over time, these forces may damage the handle and cause the two pieces to begin separating, cracking, etc.

Thus, there is a need for a two-piece razor handle with improved bending strength, and preferably with a rotatable portion, that is simpler, cost-effective, reliable, durable, easier and/or faster to manufacture, and easier and/or faster to assemble with more precision.

SUMMARY OF THE INVENTION

In accordance with an aspect of the present disclosure, a shaving razor handle is provided that comprises: a body defined by a top shell joined to a bottom shell, the body comprising an open end, in which one of the top shell or the bottom shell comprises a substantially continuous band of material that forms the open end of the body.

In accordance with another aspect of the present disclosure, a shaving razor handle is provided that comprises: a body defined by a top shell joined to a bottom shell, the body comprising an open end, in which one of the top shell or the bottom shell comprises a substantially continuous band of material that forms the open end of the body; and a forward assembly coupled to the body, in which at least a portion of the forward assembly rotates relative to the body.

In accordance with a further aspect of the present disclosure, a shaving razor handle is provided that comprises: a top shell and a bottom shell joined to the top shell to define a body, in which one of the top shell or the bottom shell comprises a substantially continuous band of material that forms an open end of the body and in which an inner edge of the one of the top shell or the bottom shell comprises: a substantially linear portion extending substantially parallel to a longitudinal axis of the body; and a curved portion extending between the substantially linear portion and the substantially continuous band of material.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

FIG. 10 is a cross-sectional view of a cover and a shaft in accordance with the present disclosure.

DETAILED DESCRIPTION OF THE INVENTION

Figure 1:
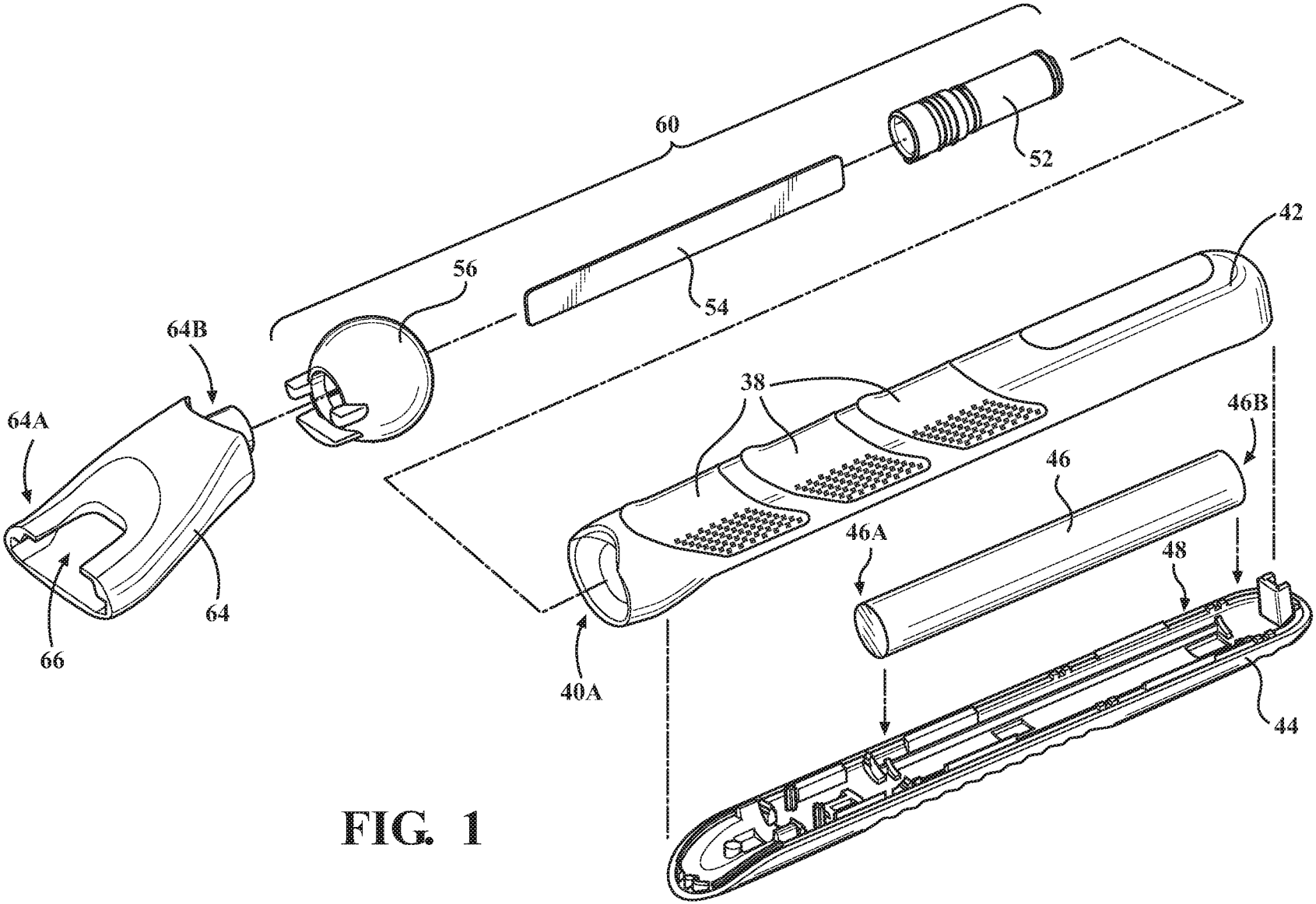
FIG. 1 is an exploded view of a razor handle in accordance with the present disclosure.
Figure 2:
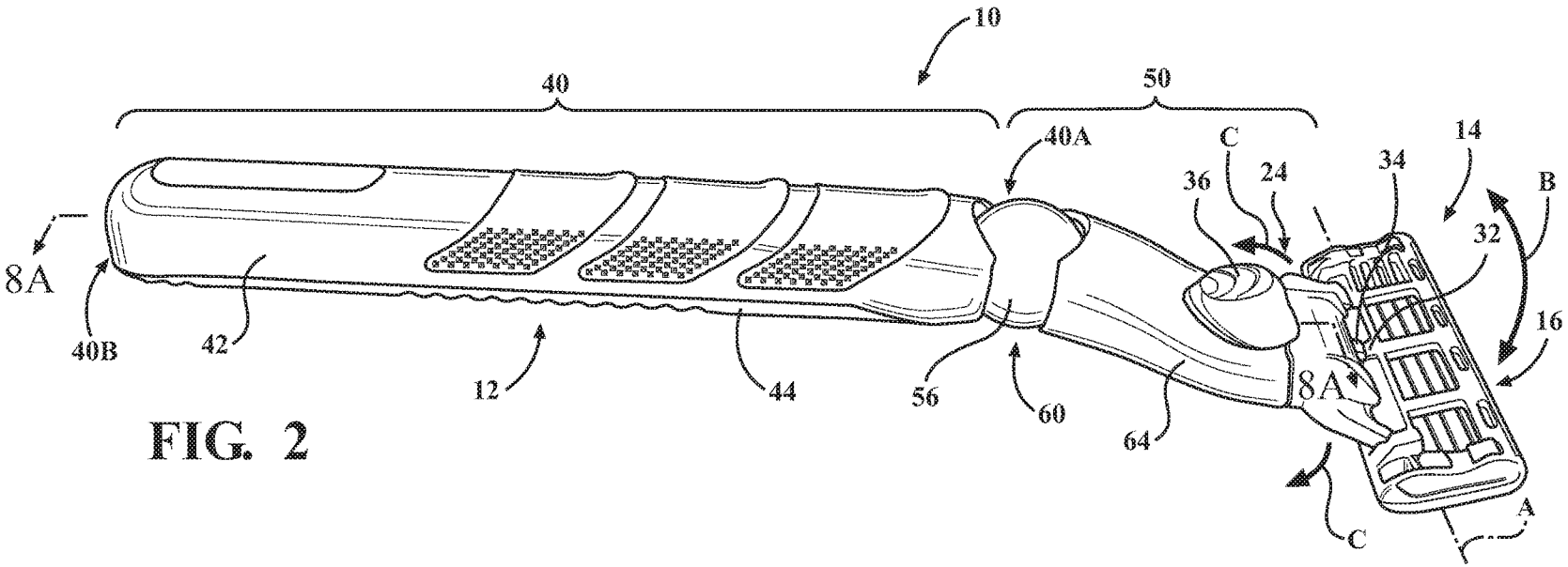
FIG. 2 is a top, perspective view of a razor system comprising a handle and a cartridge.
Figures 8A, 9:
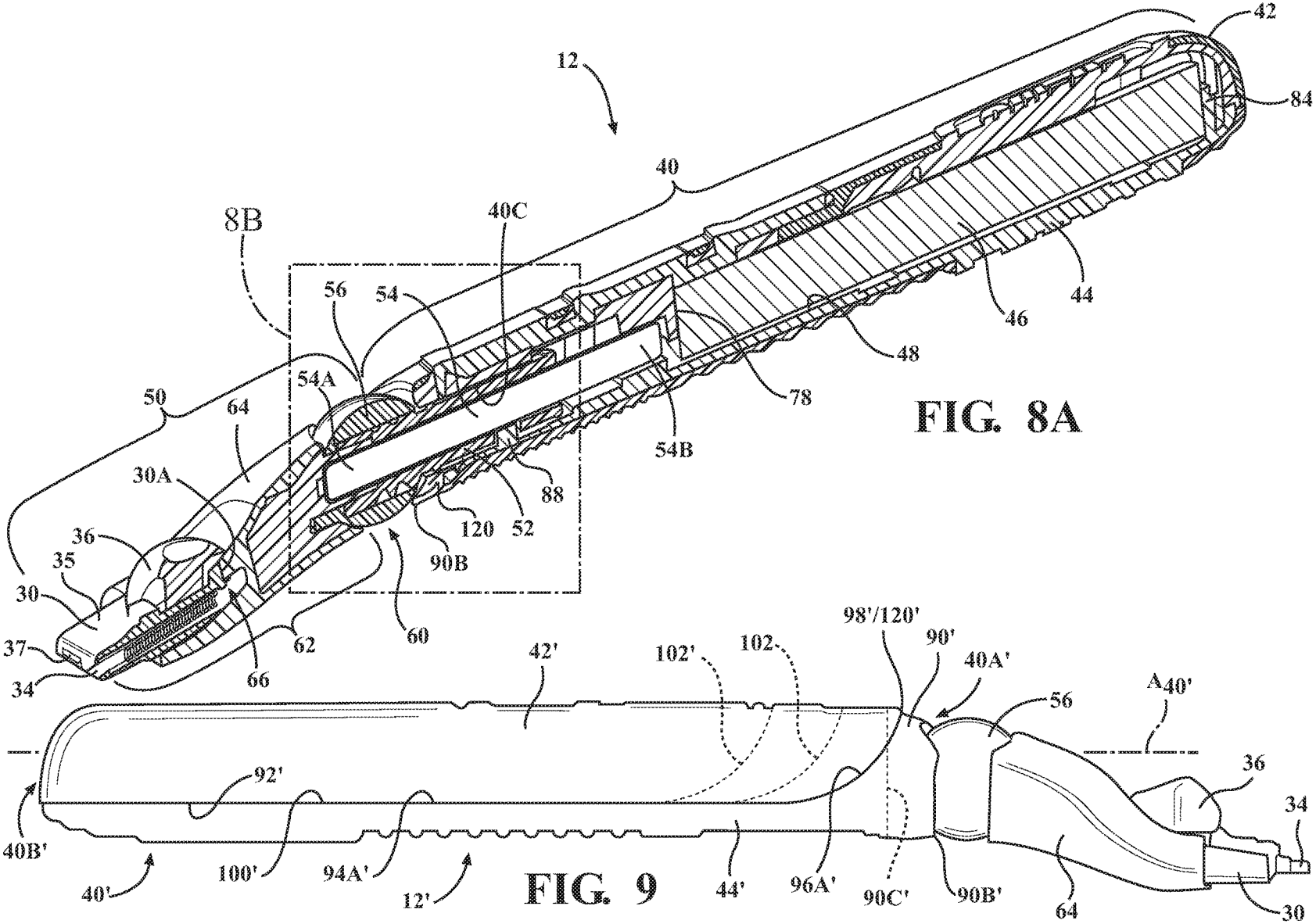
FIG. 8A is a cross-sectional view of the razor handle of FIG. 2 taken along line 8A-8A in FIG. 2.
FIG. 9 is a side view of another razor handle in accordance with the present disclosure.

With reference to FIGS. 1-3 and 5A, a razor system 10 comprises a handle 12 and a cartridge 14, which may be replaceable. The cartridge 14 comprises a cartridge housing 16, which carries a plurality of blades 18, a guard structure 20, and a cap structure 22. The cartridge 14 may also comprise an interconnect member 24 on which the cartridge housing 16 is pivotally mounted. The interconnect member 24 includes a base 26, which is releasably received by a cartridge-connecting assembly 30 of the handle 12 and two arms 28 that pivotally support the cartridge housing 16. The cartridge housing 16 pivots about an axis A (see FIG. 2) relative to the interconnect member 24 in a direction indicated by arrow B in FIG. 2. The cartridge housing 16 comprises a cam surface 32 that is acted upon by a spring-biased plunger 34 of the cartridge-connecting assembly 30. When the base 26 is connected to the handle 12, the plunger 34 passes through an opening (not shown) formed in the base 26 and engages the cam surface 32 on the cartridge housing 16 to bias the cartridge housing 16 to a rest or home position shown in FIGS. 1 and 2. The cartridge-connecting assembly 30 further comprises an eject assembly comprising a housing 35, a button 36, and eject fingers 37, one of which is shown in FIG. 8A, wherein the fingers 37 are fixedly coupled to the button 36 and mounted in the housing 35. The button 36 is received in a slot in a connecting portion 64 of the handle 12. When the button 36 is pushed toward the cartridge housing 16, the eject fingers 37 extend out from the housing 35 and eject the cartridge 14. As illustrated in FIGS. 1 and 2, the cartridge-connecting assembly 30 may comprise a conventional GILLETTE MACH3® docking interface. In other examples, the handle 12 may be provided with other docking interfaces, such as a GILLETTE FUSION® interface.

As shown in FIGS. 1-4, the handle 12 comprises a body 40 comprising a top shell 42 joined to a bottom shell 44, which may together define an elongated gripping structure. The body 40 comprises a first end 40A (also referred to herein as an open end) and a second end 40B opposite the first end 40A. While the first end 40A defines an open end and the second end 40B defines a closed end in the illustrated embodiment, in other examples (not shown), both ends 40A, 40B may be open. In some examples, the body 40 may be substantially straight, as shown in FIGS. 1-3 and 5A (see also FIGS. 8A and 9). In other examples (not shown), one or more sections of the body 40 may be offset or curved relative to one or more other sections and/or to a major longitudinal axis $A_{40}$ of the body 40 (see FIG. 5A). The body 40 may be substantially hollow and may receive a metal weight or rod 46, as described in more detail below. The metal rod 46 may comprise, for example, stainless steel with zinc plating.

As described herein in more detail, a forward assembly 50 may be coupled to the body 40, as shown in FIGS. 1-4 and 8A, in which the forward assembly 50 may comprise a handle-engaging assembly 60 and a head assembly 62. The handle-engaging assembly 60 may be coupled to, and received in, the open end 40A of the body 40 and may comprise a shaft 52, a spring 54, and an optional cover 56. The head assembly 62 may be coupled to the handle-engaging assembly 60. In particular, the head assembly 62 may comprise the connecting portion 64 and the cartridge-connecting assembly 30, in which the connecting portion 64 may be fixedly coupled at a forward end 64A to the cartridge-connecting assembly 30, e.g., via pins (not shown), and at a rear end 64B to the handle-engaging assembly 60. The forward end 64A of the connecting portion 64 may comprise a cavity 66 that receives the cartridge-connecting assembly 30. When present, the cover 56 maybe positioned between the body 40 and the head assembly 62. In some examples, at least a portion of the forward assembly 50 may rotate relative to the body 40, as described herein in detail.

Figure 4:
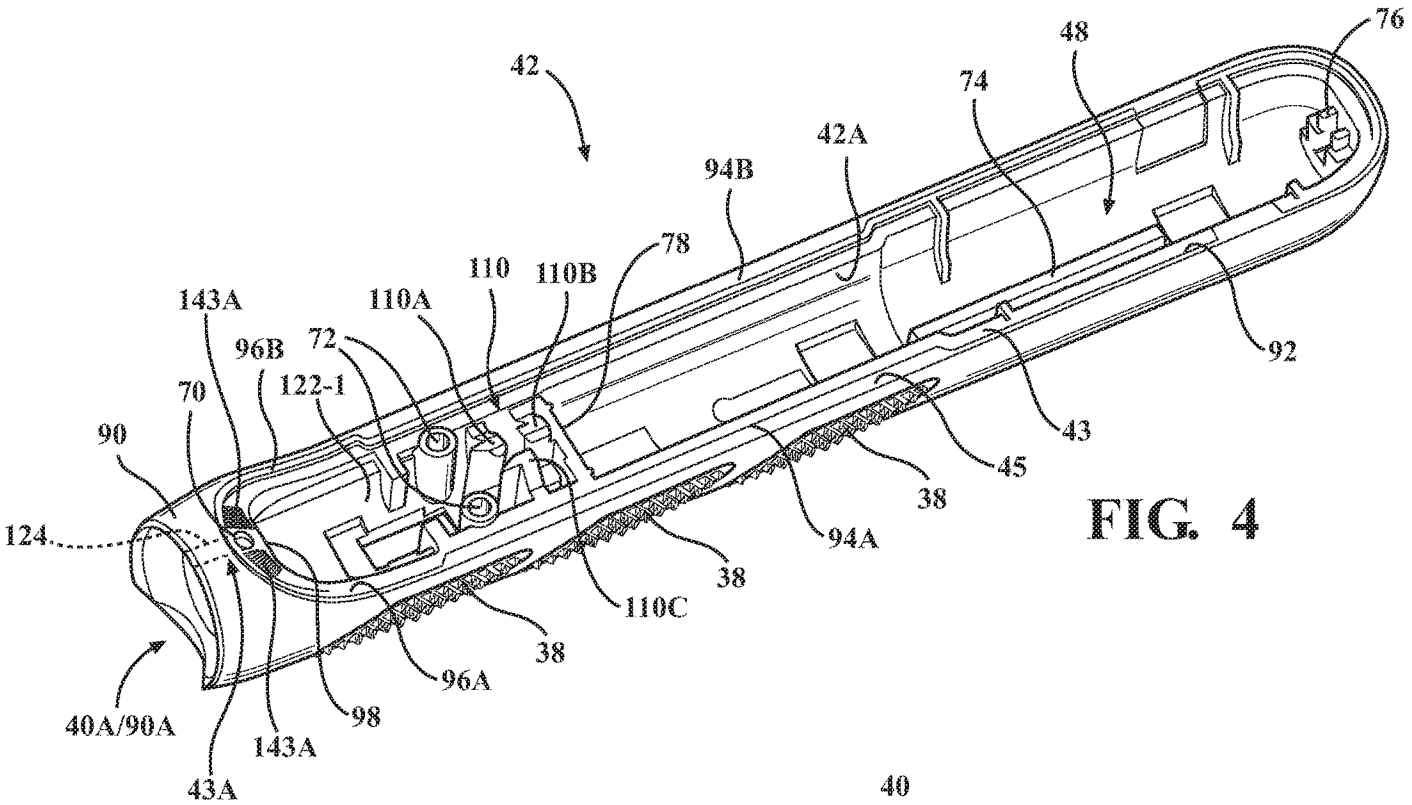
FIG. 4 is a perspective view of a top shell of a razor handle in accordance with the present disclosure.
Figure 5A:
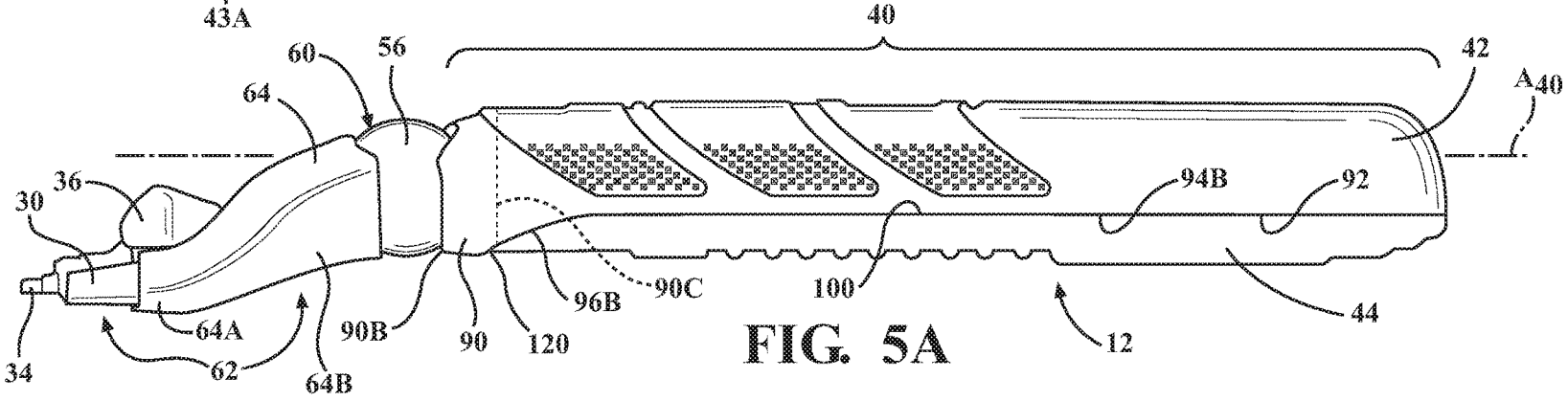
FIG. 5A is a side view of a portion of a razor handle in accordance with the present disclosure.
Figure 7:
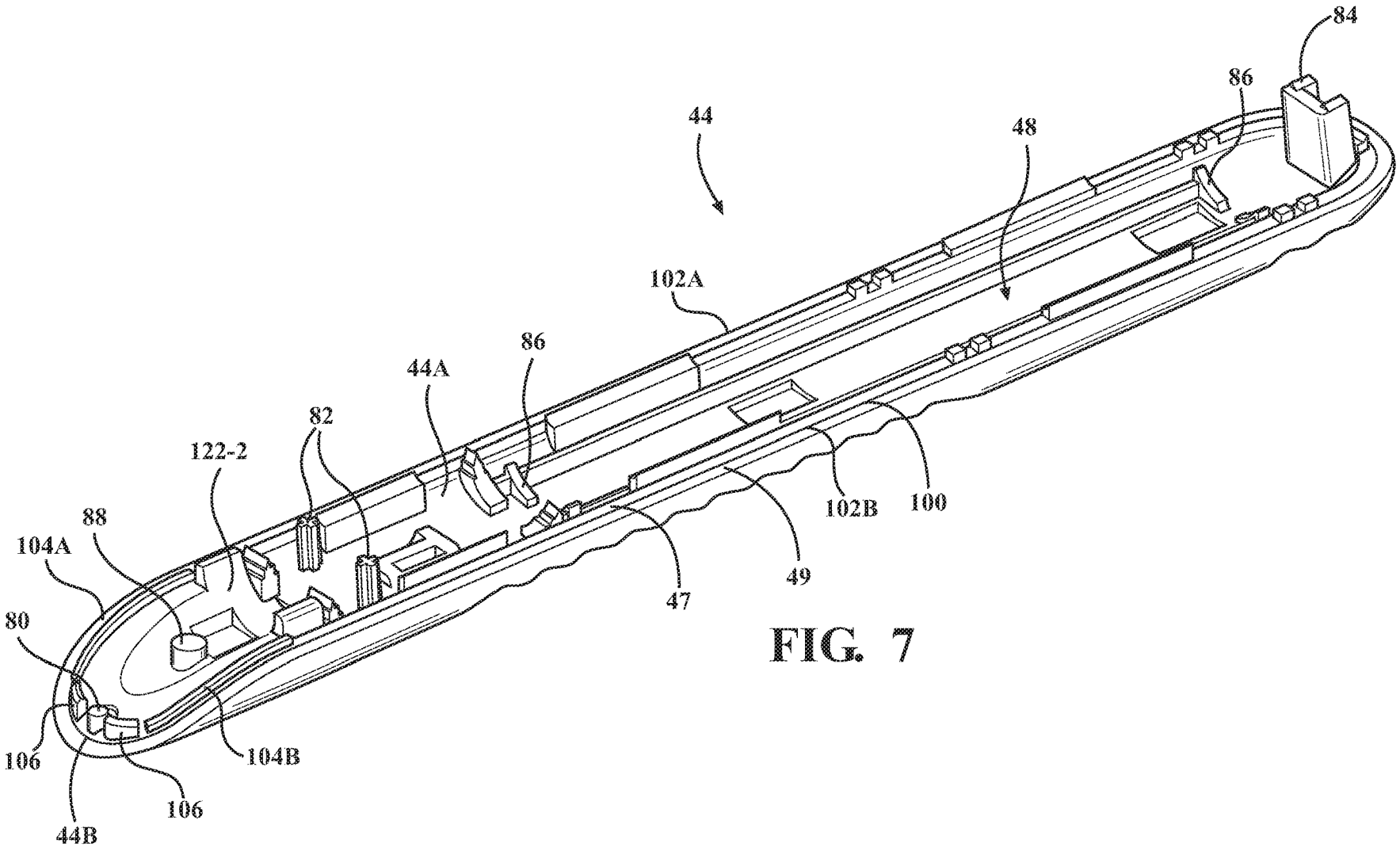
FIG. 7 is a perspective view of a bottom shell of a razor handle in accordance with the present disclosure.

With reference to FIGS. 4, 5A, and 7, the top shell and bottom shell 42, 44 may be joined at one or more points along their respective inner edges 92, 100, as shown in FIGS. 4, 5A, and 7, in which the inner edges 92, 100 define a mating surface or interface along which the top and bottom shells 42, 44 are joined to each other. The top and bottom shells 42, 44 may be joined using one or more of ultrasonic welding, adhesive, and a snap or friction fit. The inner edges 92, 100 of the top and bottom shells 42, 44 may be substantially planar, and in some examples, the top and/or and bottom shell 42, 44 may comprise a welding feature (not shown) extending around at least a portion of the respective inner edge 92, 100 that helps to join the top and bottom shells 42, 44. The welding feature may comprise a rib extending outward from one or both of the inner edges 92, 100. The rib may be sacrificed during the ultrasonic welding process and helps to join the inner edges 92, 100 together.

Figure 5B:
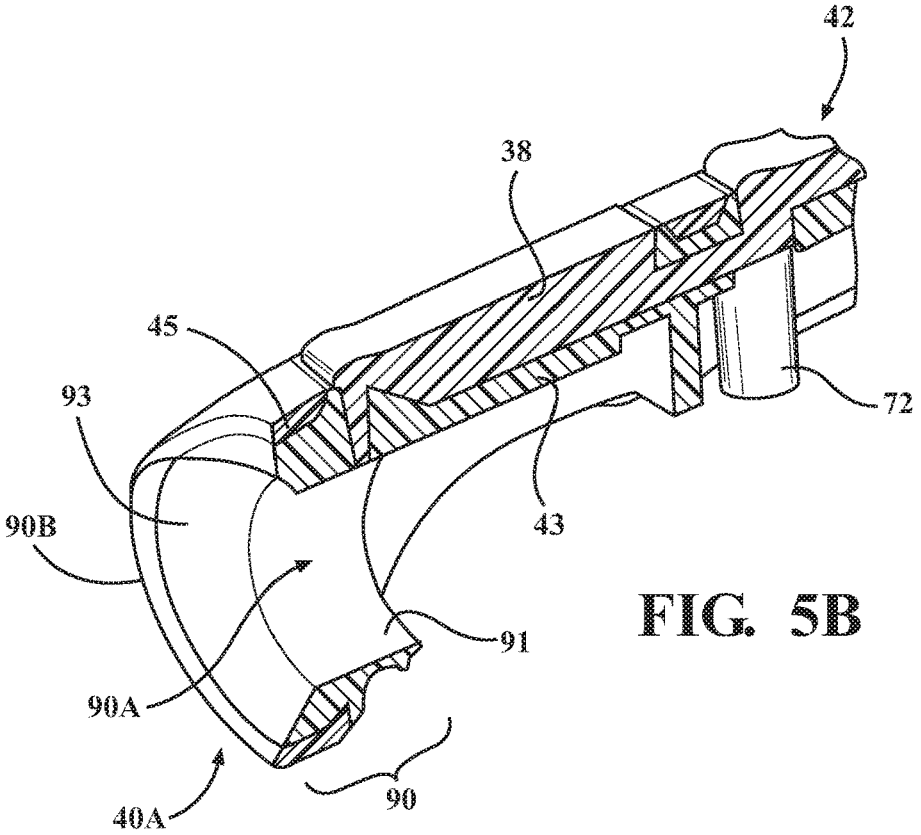
FIG. 5B is a partial, cross-sectional view of one end of the top shell of FIG. 4.

The top and bottom shells 42, 44 may be formed, for example, by molding and may comprise two or more layers and/or types of material. As shown in FIGS. 1, 4, and 5B, the top shell 42 may comprise an inner layer 43 that may comprise, for example, polycarbonate/polyethylene terephthalate (PC/PET), and an outer layer 45 that may comprise, for example, acrylonitrile butadiene styrene (ABS). The outer layer 45 may receive a metallic outer coating, e.g., chrome, via a conventional electroplating process. The top shell 42 may further comprise a plurality of upper gripping pads 38. The bottom shell 44 may comprise an inner layer 47 that may comprise PC/PET, and an outer layer 49 that forms a lower gripping pad. In the assembled handle 12, the upper gripping pads 38 and the outer layer 49 of the bottom shell 44 provide a hand-gripping structure and may comprise an elastomeric polymeric outer gripping layer (e.g., thermoplastic elastomer) and a nonelastomeric polymeric support layer (e.g., of polypropylene or ABS). The inner layers 43, 47 of the top and bottom shells 42, 44 may preferably comprise one or more materials that are durable and suitable for ultrasonic welding and/or adhesive. While the material (s) that make up the inner layers 43 are generally able to withstand the chemicals associated with the chrome plating, they may be unsuitable for chrome plating as they may not be good conductors of electrons. The outer layer 45 of the top shell 42 may comprise one or more materials that are suitable for chrome plating, e.g., have good electrical conductive properties. It is further contemplated that each of the top and bottom shells 42, 44 may comprise only a single layer and/or type of material. In these examples, the single layer of material that defines the top and bottom shells 42, 44 would generally be thicker, as compared to the layers 43, 45 and 47, 49 of the (multilayer) top and bottom shells 42, 44, to provide the required strength and durability. In all examples, the top and bottom shells 42, 44 may be made by one-shot molding, two-shot molding, etc.

The inner edge 92 of the top shell 42 may be defined by edge portions of both the inner and outer layers 43 and 45. Further, the inner edge 100 of the bottom shell 44 may be formed by edge portions of both the inner layer 47 and the outer layer 49. In the illustrated example, the edge portion of the inner layer 43 forming part of the inner edge 92 of the top shell 42 is ultrasonically welded to the edge portion of the inner layer 47 forming part of the inner edge 100 of the bottom shell 44. In other examples, the top and bottom shells 42, 44 may be joined by ultrasonically welding and/or adhering the edge portion of the outer layer 45 forming part of the inner edge 92 of the top shell 42 to the edge portion of the outer layer 49 forming part of the inner edge 100 of the bottom shell 44.

One or more structures may be formed in or on a respective interior surface 42A, 44A of the top and bottom shells 42, 44, e.g., during the molding process. These one or more structures may, for example, help to align the top and bottom shells 42, 44 with respect to each other during assembly; hold the top and bottom shells 42, 44 together; position the metal rod 46; and engage one or more other components of the handle 12, as described in detail below. With reference to FIGS. 4 and 7, the bottom shell 44 may comprise a first protrusion 80 and a pair of second protrusions 82 extending outward from the interior surface 44A of the bottom shell 44. The first protrusion 80 is received in a corresponding recess 70 formed in the inner edge 92 of the top shell 42, e.g., by a friction fit. The pair of second protrusions 82 are received in a corresponding pair of sockets 72 formed in the interior surface 42A of the top shell 42, e.g., by a friction fit. The bottom shell 44 may also comprise a projection 84 that extends outward from the interior surface 44A and fits over a corresponding structure 76 formed on the interior surface 42A of the top shell 42, e.g., by a friction fit or ultrasonic welding. The top and bottom shells 42, 44 may further comprise one or more additional structures (not separately labeled) that assist in aligning the top and bottom shells 42, 44 during assembly and/or holding the top and bottom shells 42, 44 together.

As shown in FIGS. 4, 7, and 8A, the top and bottom shells 42, 44 may define a cavity 48 with one or more structures that receive and position the metal rod 46 within the cavity 48. For example, the bottom shell 44 may comprise cradle structure 86 that receives and supports the metal rod 46, and the top shell 42 may comprise an elongated projection 74 extending outward from the interior surface 42A along at least a portion of the cavity 48 that aligns the metal rod 46 and holds it in place in the cradle structure 86 when the handle 12 is assembled. A forward end 46A of the metal rod 46 may rest against a shoulder 78 formed in the top shell 42, and a rear end 46B of the metal rod 46 may rest against the U-shaped projection 84 formed in the bottom shell 44.

One of the top shell 42 or the bottom shell 44 may comprise a structure that forms or defines the open end 40A of the body 40. With reference to FIGS. 3, 4, 5A, and 5B, in some examples, the top shell 42 may comprise a substantially continuous band of material 90 that solely forms or defines the open end 40A of the body 40 in the assembled handle 12. Hence, in this example, the open end 40A of the body 40 is formed solely within the top shell 42.

In the embodiment illustrated in FIGS. 4 and 5A, the inner edge 92 of the top shell 42 may comprise first and second substantially linear portions 94A, 94B that extend substantially parallel to the major longitudinal axis $A_{40}$ of the body 40; first and second connecting portions 96A, 96B that extend between respective ones of the first and second substantially linear portions 94A, 94B and the substantially continuous band of material 90; and an intermediate portion 98 that extends between and connects the first connecting portion 96A with the second connecting portion 96B, in which the intermediate portion 98, in the illustrated embodiment, comprises at least a portion of the continuous band of material 90. More specifically, in the embodiment illustrated in FIG. 4, the intermediate portion 98 of the inner edge 92 is defined by a portion 43A of the inner layer 43 of the top shell 42, which portion 43A forms part of the continuous band of material 90 and defines the recess 70 and a pair of generally planar sections 143A on opposing sides of the recess 70. The intermediate portion 98 of the inner edge 92 may also be defined by an adjacent portion of the outer layer 45 of the top shell 42. As best seen in FIGS. 4 and 5A, in some examples, the first and second connecting portions 96A, 96B may be curved or arched. In other examples (not shown), the first and second connecting portions 96A, 96B may be substantially linear and may extend at an angle between the first and second substantially linear portions 94A, 94B and the intermediate portion 98. In further examples (not shown), one or more sections of the portions 94A, 94B may be non-linear, e.g., comprising a curve or other shape. In yet further examples (not shown), one or more sections of the inner layer 43 may comprise a different shape, as compared to the corresponding section(s) of the outer layer 45.

As shown in FIG. 7, the inner edge 100 of the bottom shell 44 may comprise third and fourth substantially linear portions 102A, 102B that extend substantially parallel to one another; third and fourth connecting portions 104A, 104B, and an intermediate portion 106, in which the intermediate portion 106 connects the third connecting portion 104A with the fourth connecting portion 104B.

After the bottom shell 44 is assembled to the top shell 42, the inner edges 92 and 100 are located adjacent to one another. More specifically, the first and second substantially linear portions 94A, 94B of the top shell 42 are adjacent to the third and fourth linear portions 102A, 102B of the bottom shell 44; the first and second connecting portions 96A, 96B of the top shell 42 are adjacent to the third and fourth connecting portions 104A, 104B of the bottom shell 44; and the intermediate portion 98 of the top shell 42 is adjacent to the intermediate portion 106 of the bottom shell 44. As noted above, the edges 92 and 100 may be joined using one or more of ultrasonic welding, adhesive, and a snap or friction fit. In all examples, the inner edge 100 of the bottom shell 44 may comprise a shape that corresponds to adjacent portions of the inner edge 92 of the top shell 42. For example, when the connecting portions 96A, 96B of the top shell 42 extend at an angle and/or the portions 94A, 94B of the top shell 42 comprise a non-linear shape as described above, the corresponding portions 102A, 102B, 104A, 104B of the bottom shell 44 may comprise a corresponding shape.

In the illustrated embodiment, the substantially continuous band of material 90 is defined by the top shell 42, which may comprise the inner layer 43 and the outer layer 45, as shown, or may comprise a single layer (not shown). The substantially continuous band of material 90 may comprise a substantially annular shape that may be defined between a forward edge 90B, which may comprise a point on the substantially continuous band of material 90 that is furthest from the second end 40B of the body 40, and a rear edge 90C, as shown in FIGS. 5A and 5B. In some particular examples, the substantially continuous band of material 90 may comprise a solid (continuous and without any gaps) band of material that extends completely around the open end 40A of the body 40 in a circumferential direction. In other examples, the substantially continuous band of material 90 may have one or more gaps or slits represented by lines 124 (shown in phantom in FIG. 4) defined between adjacent sections of material. In some instances, when a gap/slit is present in the substantially continuous band of material 90, the top shell 42 may comprise a pair of recesses (not shown) in place of the single recess 70 that are located on either side of the gap/slit (e.g., near the current location of the generally planar sections 143A), and the bottom shell 44 may comprise a pair of protrusions (not shown; near the current location of the intermediate portion 106) in place of the single protrusion 80 that are received in the pair of recesses to help stabilize the gap/slit and hold the adjacent sections of material in proximity to each other. The substantially continuous band of material 90 may define a continuous arc extending circumferentially from about 335 degrees to about 360 degrees, preferably from about 340 degrees to about 360 degrees, and most preferably comprises an arc of 360 degrees (i.e., continuous and without any gaps or slits). If a gap/slit is provided, it may comprise an arc extending circumferentially slightly greater than 0 degrees and less than 25 degrees and preferably slightly greater than 0 degrees and less than 20 degrees.

As shown in FIG. 9, in other examples, a handle 12' may comprise a top shell 42' and a bottom shell 44' that are joined to form a body 40', in which the bottom shell 44' comprises a substantially continuous band of material 90' that forms or defines an open end 40A' of the body 40'. In this example, the open end 40A' of the body 40' is formed solely within the bottom shell 44', i.e., solely by the continuous band of material 90' of the bottom shell 44'. An inner edge 100' of the bottom shell 44' comprises a first substantially linear portion 94A' that extends substantially parallel to a major longitudinal axis $A_{40'}$ of the body 40' and a first connecting portion 96A' that extends between the first substantially linear portion 94A' and the substantially continuous band of material 90'. Although not visible in FIG. 9, similar to the top shell 42 in FIG. 4, the inner edge 100' of the bottom shell 44' may further comprise a second substantially linear portion and a second connecting portion. The shape of the respective inner edges 92', 100' may be as described above in detail with respect to the inner edges 92, 100 of the handle 12. In particular, the first and second connecting portions 96A' may be curved or arched, as shown, or may be substantially linear (not shown), as described in detail above. An intermediate portion 98' may extend between and connect the first connecting portion 96A' with the second connecting portion, in which the intermediate portion 98' may comprise at least a portion of the continuous band of material 90', also as described above.

The substantially continuous band of material 90' formed on the bottom shell 44' may comprise features substantially similar to corresponding portions of the substantially continuous band of material 90 formed on the top shell 42 and may comprise a substantially annular shape which may be defined between a forward edge 90B' and a rear edge 90C'. Also as described above, the substantially continuous band of material 90' may comprise a solid (continuous and without any gaps) band of material that extends completely around the open end 40A' of the body 40' in a circumferential direction, and in other examples (not shown), the substantially continuous band of material 90' may have one or more gaps or slits 'defined between adjacent sections of material. In some instances, the substantially continuous band of material 90' may comprise a relatively small axial section of material, extending generally parallel to the longitudinal axis $A_{40'}$ of the body 40'. In other instances, the substantially continuous band of material 90' may comprise a larger axial section of material. For instance, in other embodiments and with continued reference to FIG. 9, the inner edge 100' of the bottom shell 44' may comprise the substantially linear portion 94A' and one of a first connecting portion 102 or a first connecting portion 102', both shown in dotted line and one of which is used in place of the first connecting portion 96A'. Each of the connecting portions 102, 102' may be curved, as shown, or may be substantially linear (not shown).

Figure 6:
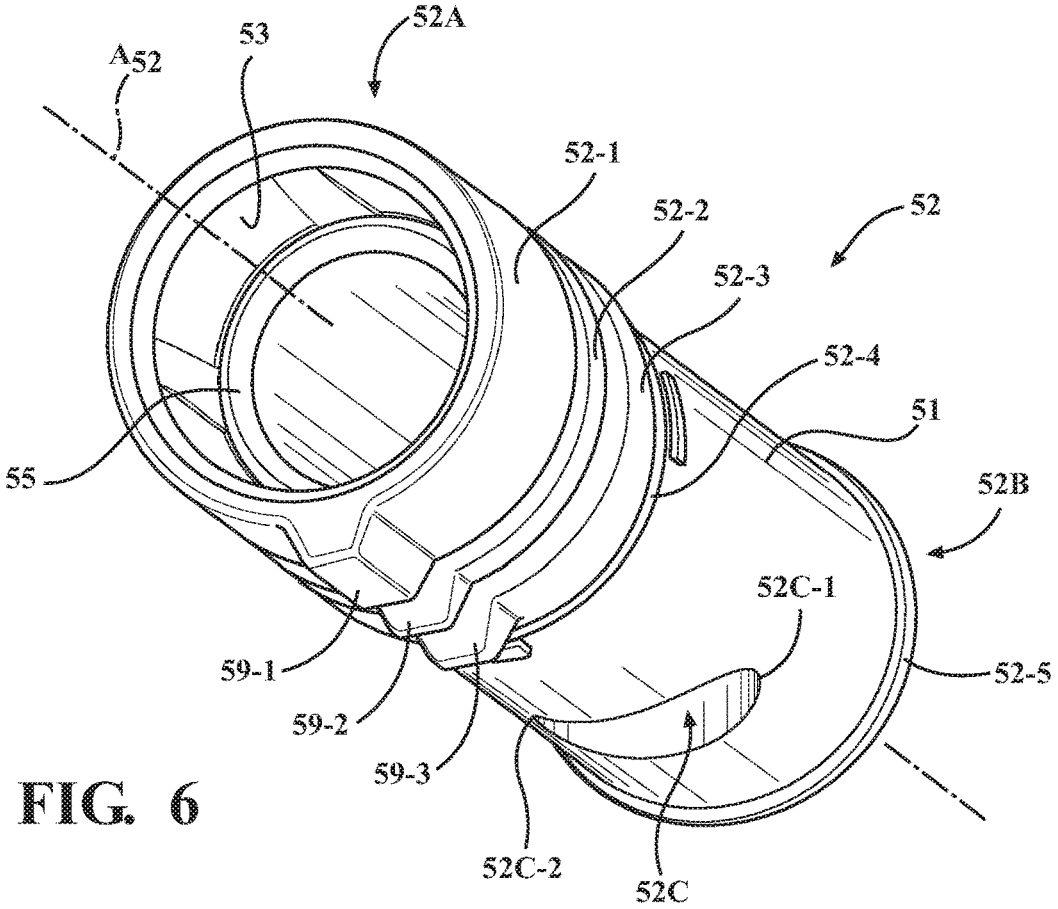
FIG. 6 is a perspective view of a shaft in accordance with the present disclosure.
Figure 11:
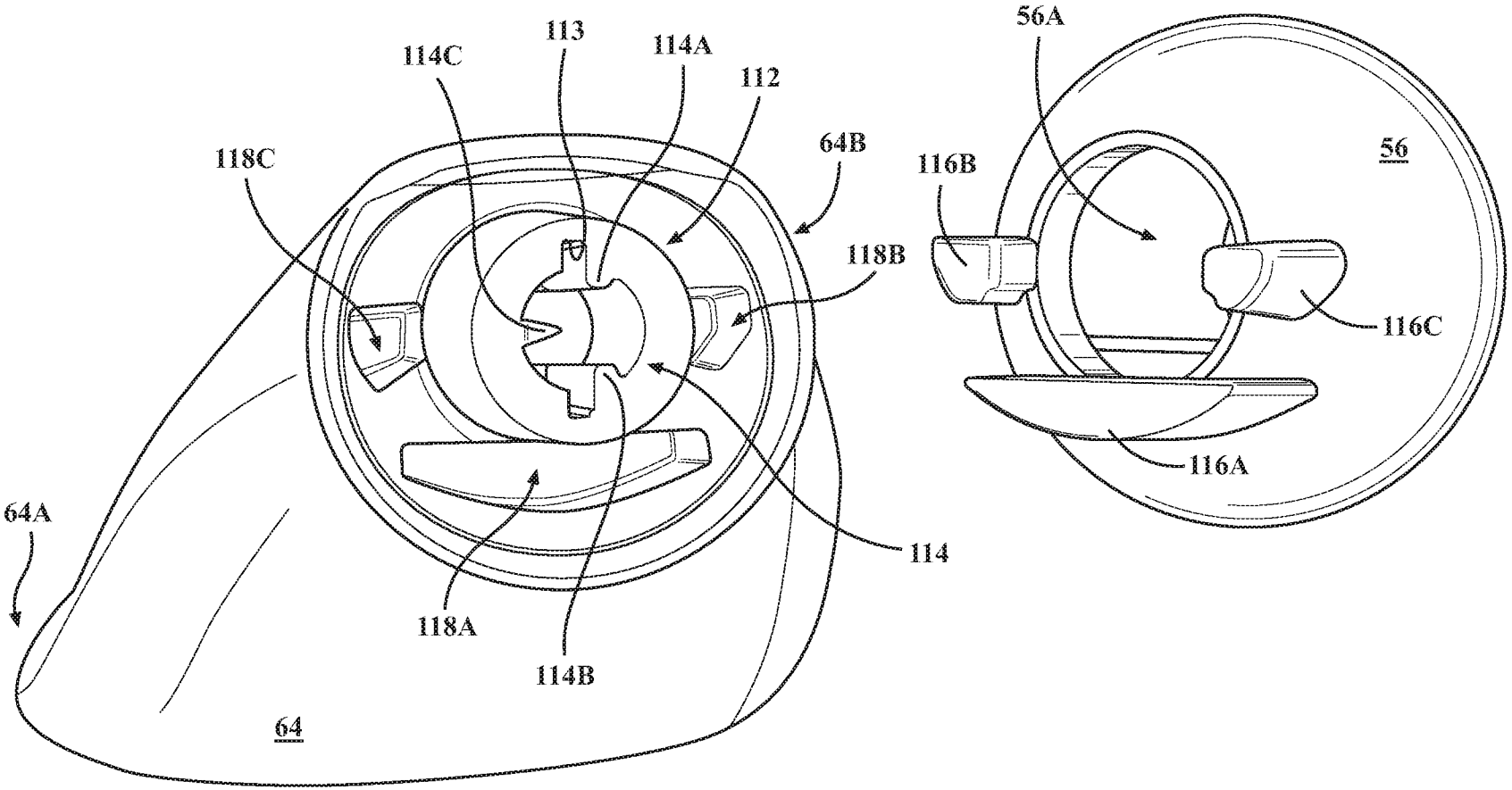
FIG. 11 is a perspective view of a cover and a connecting portion in accordance with the present disclosure.

With reference to FIGS. 1, 6, 7, 8A, and 10, the shaft 52 of the handle-engaging assembly 60 may extend between the body 40 and the connecting portion 64. In particular, the shaft 52 may extend partially into the body 40, i.e., a rear end 52B of the shaft 52 may be received in the open end 40A of the body 40, as described herein in more detail. The shaft 52 may further be coupled at a forward end 52A to the head assembly 62, and more particularly, to the connecting portion 64. With reference to FIGS. 6, 8A, and 11, the connecting portion 64 may comprise a post 112 extending outward from the rear end 64B, and the forward end 52A of the shaft 52 may fit over and receive a portion of the post 112. The connecting portion 64 may comprise inner and outer portions (not separately labeled), in which the inner portion may comprise, for example, ABS and may include the post 112 and recesses 118A to 118C (see FIG. 11) and the outer portion may comprise, for example, PC/PET and may receive a metallic outer coating, e.g., chrome, via a conventional electroplating process. In the example shown, an interior surface 53 of the shaft 52 may comprise a shoulder 55 that engages the post 112. As described in more detail below, the forward end 52A of the shaft may be coupled to the post 112 via a friction fit and/or via one or more other suitable techniques, such as ultrasonic welding or adhesive, and preferably is fixed to the post 112 so as not to rotate relative to the post 112 or disengage from the post 112.

The spring 54 may extend between the body 40 and the connecting portion 64, with the shaft 52 surrounding at least a portion of the spring 54. The spring 54 may comprise, for example, a flat torsion spring with a forward end 54A and a rear end 54B and may comprise, for example, stainless steel. The top shell 42 may comprise a first spring receiving structure 110, which may be formed adjacent to and/or share a wall with the shoulder 78 and may receive the rear end 54B of the spring 54. The first spring receiving structure 110 may comprise, for example, first, second, and third projections 110A-110C formed on the interior surface 42A of the top shell 42. The first and second projections 110A, 110B may be located substantially opposite the third projection 110C. A portion of the first and second projections 110A, 110B may extend toward the third projection 110C, and a portion of the third projection 110C may extend inward at least partially between the first and second projections 110A, 110B, such that when the rear end 54B of the spring 54 is inserted into the first spring receiving structure 110, the portion of the third projection 110C contacts the rear end 54B of the spring 54 and pushes it against the portions of the first and second projections 110A, 110B to hold the spring 54 in place, at least in part, via a friction fit.

The forward end 54A of the spring 54 may be received in a second spring receiving structure 114 formed within the post 112 in the connecting portion 64. Similar to the first spring receiving structure 110, the second spring receiving structure 114 may comprise first, second, and third projections 114A-114C, in which the first and second projections 114A, 114B may be located substantially opposite the third projection 114C. A portion of the first and second projections 114A, 114B extend inward toward the third projection 114C, and a portion of the third projection 114C may extend inward at least partially between the first and second projections 114A, 114B, such that when the forward end 54A of the spring 54 is inserted into the second spring receiving structure 114, the portion of the third projection 114C contacts the forward end 54A of the spring 54 and pushes it against the portions of the first and second projections 114A, 114B to hold the spring 54 in place, at least in part, via a friction fit.

With reference to FIGS. 1-3, 5A, and 8A, the cover 56 may optionally be positioned between the open end 40A of the body 40 and the connecting portion 64. The cover 56 may comprise, for example, ABS that may be coated, e.g., using vacuum metal deposition, with a metal such as aluminum, and a clear coat may be applied over the metal coating. The cover 56 may comprise a central opening 56A that receives the shaft 52 such that the cover 56 surrounds at least a portion of the shaft 52. An outer surface 51 of the shaft 52 may comprise one or more structures that engage one or more portions of the cover 56 to, for example, align the shaft 52 with the cover 56. As shown in FIGS. 6 and 10, the forward end 52A of the shaft 52 may comprise one more circumferential ridges 52-1 to 52-3 formed in the outer surface 51 of the shaft 52. The shaft 52 may comprise, for example, ABS and may be molded so as to form the circumferential ridges 52-1 to 52-3 and other structures described herein. When the shaft 52 is inserted into the central opening 56A of the cover 56, the circumferential ridges 52-1 to 52-3 engage an interior surface 57 of the cover 56 defining the central opening 56A of the cover 56. One or more of the circumferential ridges 52-1 to 52-3 may comprise a respective extension 59-1 to 59-3 extending radially outward from the ridges 52-1 to 52-3 in a direction perpendicular to a longitudinal axis $A_{52}$ of the shaft 52. The cover 56 may further comprise a notch 56B that is in communication with the central opening 56A. When the shaft 52 is inserted into the central opening 56A of the cover 56, the extensions 59-1 to 59-3 may be received in the notch 56B. Engagement between the extensions 59-1 to 59-3 and the notch 56B may align the shaft 52 with respect to the cover 56. As will be discussed further below, because the shaft 52 is coupled to the connecting portion 64 and is provided with an aperture 52C that engages with an extension 88 on the bottom shell 44, aligning the shaft 52 with respect to the cover 56 allows the forward assembly 50 to be aligned with respect to the body 40. Engagement between the extensions 59-1 to 59-3 and the notch 56B may further prevent unwanted rotation of the shaft 52 with respect to the cover 56.

The cover 56 may comprise one or more structures that engage one or more corresponding structures formed in the head assembly 62. For example, as best seen in FIG. 11, the cover 56 may comprise one or more protrusions 116A to 116C that are received in one or more corresponding recesses 118A to 118C formed in the rear end 64B of the connecting portion 64. Engagement between the one or more protrusions 116A to 116C and the one or more corresponding recesses 118A to 118C may align the cover 56 with respect to the head assembly 62, specifically with respect to the connecting portion 64. Engagement between the protrusions 116A to 116C and recesses 118A to 118C may also help to prevent unwanted rotation of cover 56 with respect to the connecting portion 64. The forward end 64A of the connecting portion 64 is coupled to the cartridge-connecting assembly 30, as shown in FIGS. 5A and 8A. In some examples as shown, a section of the connecting portion 64 may be offset relative to the longitudinal axis $A_{40}$ of the body 40.

Figure 8B:
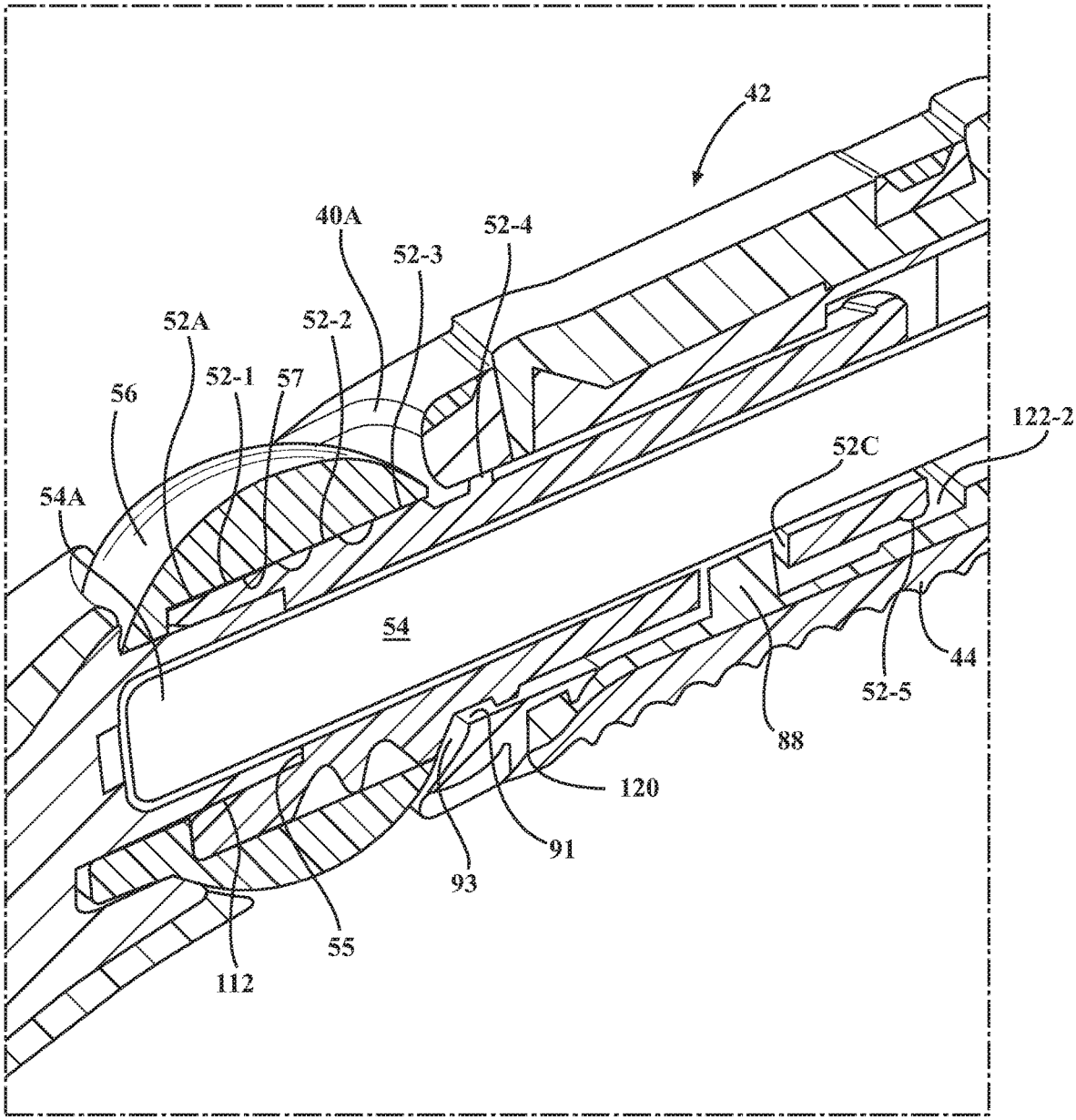
FIG. 8B is an enlarged view of a portion of FIG. 8A.

An outer shape of the cover 56 may comprise any suitable shape. In the examples shown, an outer shape of the cover 56 may be substantially spherical, and the portion of the substantially continuous band of material 90 adjacent to the cover 56 may comprise a curved section 93 that substantially corresponds to the outer shape of the cover 56, as shown in FIGS. 5B and 8B. In other examples (not shown), the cover may be integral with the connecting portion 64. For instance, the cover may comprise a substantially cylindrical section of material that is integral with the rear end 64B of the connecting portion 64 and extends outward from the rear end 64B toward the open end 40A of the body 40. In further examples (not shown), the cover may be absent, and the forward assembly 50 may be modified such that the connecting portion 64 is adjacent to the open end 40A of the body 40. For instance, a dimension of the shaft 52 and/or spring 54 may be decreased, in a direction parallel to the major longitudinal axis $A_{40}$ of the body 40, such that the rear end 64B of the connecting portion 64 is adjacent to the open end 40A of the body 40.

To assemble the handle 12, in one example, the post 112 of the connecting portion 64 may be inserted into the central opening 56A of the cover 56 such that the protrusions 116A to 116C of the cover 56 are inserted into the recesses 118A to 118C formed in the connecting portion 64, which may involve a friction fit between the post 112 and the central opening 56A and/or the protrusions 116A to 116C and the recesses 118A to 118C. The forward end 52A of the shaft 52 may then be inserted into the cover 56 and over the post 112 of the connecting portion 64, with the extensions 59-1 to 59-3 engaging the notch 56B to align the shaft 52 with respect to the cover 56 (and with respect to the connecting portion 64). The shaft 52, the cover 56, and the connecting portion 64 may then be ultrasonically welded together. The forward end 54A of the spring 54 may be inserted into the shaft 52 and pressed into the second spring receiving structure 114 formed in the connecting portion 64. The spring 54 may be inserted before or after the shaft 52, the cover 56, and the connecting portion 64 are joined together by ultrasonic welding. The rear ends 52B, 54B of the shaft 52 and spring 54, respectively, may then be inserted into the open end 40A of the body 40, with the rear end 54B of the spring 54 being pressed into the first spring receiving structure 110. Alternatively, following joining of the shaft 52, the cover 56, and the connecting portion 64, the rear end 52B of the shaft 52 may be inserted into the open end 40A of the body 40, after which the spring 54 may be installed by tilting the shaft 52 slightly, inserting the forward end 54A of the spring 54 into the second spring receiving structure 114, and inserting the rear end 54B of the spring 54 into the first spring receiving structure 110. Thereafter, the top and bottom shells 42, 44 may be pressed together, which may involve a friction or snap fit between one of more of the structures formed on the interior surfaces 42A, 44A, as described above. The top and bottom shells 42, 44 may then be joined together along one or more portions of their respective inner edges 92, 100 using, for example, ultrasonic welding and/or adhesive.

In another example, the cover 56 and the connecting portion 64 may be assembled as described above and, thereafter, an adhesive may be introduced into the central opening 56A of the cover 56. The adhesive may comprise, for example, a polyurethane resin, such as a two-component resin that cures at room temperature. The forward end 52A of the shaft 52 may be inserted into the cover 56 and over the post 112, as described above, which results in a bond being formed between the shaft 52, the cover 56, and the connecting portion 64 via the adhesive. The spring 54 may be inserted before or after the shaft 52, the cover 56, and the connecting portion 64 are joined together by the adhesive. Assembly of the handle 12 may then proceed as described above. The handle 12' depicted in FIG. 9 may be assembled in a similar manner. In all examples, at any point during assembly of the handle 12, the cartridge-connecting assembly 30 including the button 36 may be installed in the forward end 64A of the connecting portion 64.

Figure 3:
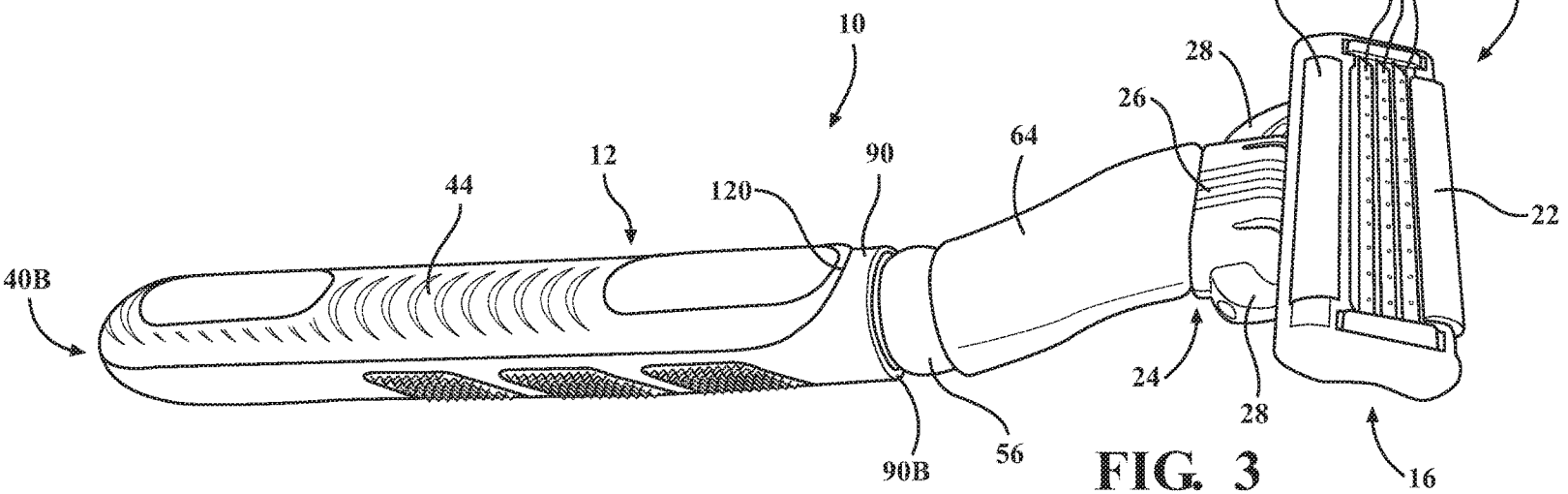
FIG. 3 is a bottom, perspective view of the razor system of FIG. 1.

In all embodiments, one or more components of the handle-engaging assembly 60 may extend past at least a portion of a joint formed between the top and bottom shells 42, 44 in a direction toward the second end 40B of the body 40. With reference to FIGS. 3, 5A, and 9, the top and bottom shells 42, 44 comprise one or more joints, or one continuous joint, along their respective inner edges 92, 100 at which the top and bottom shells 42, 44 are joined, with a forward joint 120 being formed between the top shell 42 and a forwardmost point 44B of the bottom shell 44. One or more components of the handle-engaging assembly 60, e.g., the shaft 52 and/or the spring 54, may extend past the forward joint 120 in a direction toward the second end 40B of the body 40. Although not visible in FIG. 9, one or more of the components of the handle engaging-assembly (not labeled) would similarly extend past a forward joint 120' formed between the bottom shell 44' and a forwardmost point (not labeled) of the top shell 42' in a direction toward the second end 40B' of the body 40'.

In addition, in all embodiments, a forward end of the substantially continuous band of material 90 may be closer to a joint between the top and bottom shell 42, 44 than to the cartridge-connecting assembly 30. With reference to FIGS.

3, 5A, 5B, and 8A, the forward edge 90B of the substantially continuous band of material 90, which may define the forward end of the substantially continuous band of material 90, may be closer to the forward joint 120 than to a rear edge 30A of the cartridge-connecting assembly 30. Similarly, as shown in FIG. 9, the forward edge 90B' of the substantially continuous band of material 90', which may define the forward end of the substantially continuous band of material 90', may be closer to the forward joint 120' between the top and bottom shells 42', 44' than to a rear edge (not shown) of the cartridge-connecting assembly 30. In some particular examples, as shown in FIGS. 5A and 9, the respective substantially continuous bands of material 90, 90' may be adjacent to the joint 120, 120'.

With reference to FIGS. 4, 6, 7, 8A, and 8B, the body 40 and/or shaft 52 may comprise one or more structures to retain the shaft 52 within the body 40. In some examples, the rear end 52B of the shaft 52 may comprise the aperture 52C, and an interior surface 40C of the body 40 may comprise a structure that engages the aperture 52C. For instance, the interior surface 44A of the bottom shell 44 may comprise an extension 88 that engages the aperture 52C. As shown in FIGS. 8A and 8B, upon assembly of bottom shell 44 to the top shell 42, engagement between the aperture 52C and the extension 88 prevents the shaft 52 from moving forward out of the open end 40A of the body 40. The aperture 52C may extend fully through a thickness of the shaft 52, as shown, or may extend only partially through the thickness of the shaft 52 (not shown). In other examples (not shown), such as when the bottom shell 44' comprises the substantially continuous band of material 90' (see FIG. 9), an interior surface of the top shell 42' may comprise an extension that engages the aperture 52C formed in the shaft 52 and prevents the shaft 52 from moving forward out of the body 40'. In further examples (not shown), an outer surface 51 of the shaft 52 may comprise an extension, and the interior surface 40C of the body 40 may comprise a recess that receives and engages the extension so as to secure the shaft 52 within the body 40. In some instances, the extension may be formed on, i.e., integral with, the shaft 52 or body 40 (e.g., molded during the manufacturing process). In other instances, the extension may be a separate element such as a pin or rod coupled to the shaft 52 and/or the body 40 during manufacture (e.g., via ultrasonic welding or by insertion). Although the aperture 52C is depicted in FIGS. 6 and 10 as having a substantially oval shape and the extension 88 is depicted in FIG. 4 as having a substantially circular or cylindrical shape, it is understood that the aperture 52C and the extension 88 may comprise any suitable shape, such as a square or rectangular shape.

In other embodiments (not shown), the shaft 52 may comprise a raised collar that extends at least partially around a circumference of the shaft 52 and engages the extension formed in the interior surface 40C of the body 40, in which engagement between the raised collar and the extension prevents the shaft 52 from moving forward out of the body 40. In further embodiments (not shown), the shaft 52 may comprise a generally cylindrical cage-like or lattice structure with one or more additional openings.

In other embodiments, one or more structures of the body 40 and/or shaft 52 may engage one or more additional components (not shown), such as a washer ring or other structure, to retain the shaft 52 within the body 40 via an indirect engagement between the body 40 and the shaft 52. For instance, a semicircular or horseshoe-shaped element (not shown) may fit over the shaft 52 and engage a structure (e.g., a groove or raised collar; not shown) defined on the outer surface 51 of the shaft 52 and extending at last partially around the circumference of the shaft 52. The interior surface 40C of the body 40 may comprise a structure (e.g., a groove or ledge; not shown) that engages the element to retain the shaft 52 within the body 40 and prevent the shaft 52 from moving forward out of the body 40.

The body 40 and/or shaft 52 may further comprise one or more structures that allow rotation of at least a portion of the forward assembly 50 relative to the body 40, as indicated by arrow C in FIG. 2. In particular, at least a portion of the handle-engaging assembly 60 may rotate, such that the head assembly 62 is able to rotate relative to the body 40. For example, the shaft 52 and a portion of the spring 54 may rotate relative to the body 40. The shaft 52 may comprise one or more circumferential features that contact one or more respective bearing surfaces formed on the interior surface 40C of the body 40 and allow the shaft 52 to rotate relative to the body 40. As shown in FIGS. 6 and 8B, the outer surface 51 of the shaft 52 may comprise one or more additional circumferential ridges 52-4, 52-5. A first one of the additional circumferential ridges 52-4 may be located at or near a middle portion of the shaft 52 and may engage a first circumferential bearing surface, which may be defined by a portion of an interior surface 91 of the substantially continuous band of material 90 (see also FIG. 5B). In some examples, the first circumferential bearing surface may be located entirely within the substantially continuous band of material 90. As shown in FIGS. 4, 6, and 8B, a second one of the additional circumferential ridges 52-5 may be located near a rear edge (not separately labeled) of the shaft 52 and may engage a second circumferential bearing surface, which may be defined by a top bearing surface 122-1 that is formed in the top shell 42 and a bottom bearing surface 122-2 that is formed in the bottom shell 44. Alternatively, or in addition to the circumferential ridges 52-4, 52-5, the one or more circumferential features may comprise a plurality of pads (not separately labeled) that are arranged circumferentially on the outer surface 51 of the shaft 52 at or near a location of the circumferential ridges 52-4, 52-5. These pads may be separate or discontinuous (i.e., they do not extend around an entirety of the circumference of the shaft 52) and may replace or augment the circumferential ridges 52-4, 52-5 to, for example, ensure a close fit between the shaft 52 and the circumferential bearing surfaces of the body 40.

As described above, the interconnect member 24 of the cartridge 14 is releasably received by the cartridge-connecting assembly 30, the cartridge-connecting assembly 30 is fixedly coupled to the forward end 64A of the connecting portion 64, and the shaft 52 is fixedly coupled to the rear end 64B of the connecting portion 64, such that the head assembly 62, i.e., the connecting portion 64 and the cartridge-connecting assembly 30, as well as the cartridge 14, are able to rotate with the shaft 52, relative to the body 40. When present, the cover 56 may be coupled to the connecting portion 64 and the shaft 52 also as described above, such that the cover 56 rotates with the shaft 52 and the head assembly 62. The curved section 93 of the substantially continuous band of material 90 may accommodate the outer shape of the cover 56 to allow the cover 56 to rotate freely without contacting the body 40.

As described above, the spring 54 may be coupled at the forward end 54A to the connecting portion 64 and at the rear end 54B to the body 40, and a portion of the spring 54 may rotate or flex upon rotation of the head assembly 62. In particular, upon rotation of the head assembly 62, the portion of the spring 54 extending between the first and second spring receiving structures 110, 114 may rotate or flex from a neutral or starting position (0 degrees) to a flexed position. The flexed position may be from about +/−18 degrees from the neutral position. Twisting of the spring 54 generates a return torque that biases the spring 54, along with the head assembly 62 and shaft 52, back to their respective starting positions. Rotation of the head assembly 62 may occur, for example, as a user is shaving and the head assembly 62 rotates and twists to accommodate the contours of a surface that is being shaved.

The body 40 and/or shaft 52 may optionally comprise one or more structures to limit rotational movement of the portion(s) of the forward assembly 50 relative to the body 40. In particular, in the embodiment illustrated in FIGS. 6, 8A, and 8B, engagement between the extension 88 and the aperture 52C may limit rotational movement of the shaft 52, thereby limiting rotational movement of the portion(s) of the forward assembly 50 and providing a hard stop. The aperture 52C may have axial and circumferential inner dimensions, and engagement between the extension 88 and circumferentially spaced apart edges 52C-1, 52C-2 of the aperture 52C may define the amount of rotation of the portion(s) of the forward assembly 50 relative to the body 40, i.e., limits an extent of rotational motion by the shaft 52 relative to the body 40, thereby limiting rotational movement of the portion(s) of the forward assembly 50 relative to the body 40. The aperture 52C and the extension 88 may each comprise any suitable shape, as described above, and/or dimension that allows engagement therebetween. In one particular example, the circumferential dimension of the aperture 52C may be greater than the axial dimension of the aperture 52C and the extension 88 has an outer diameter that is closer in size to the aperture axial dimension than to the aperture circumferential dimension. As shown in FIGS. 6, 7, and 8B, an inner dimension of the aperture 52C may be larger, in a circumferential direction, than an outer dimension of the extension 88 such that the shaft 52 is able to rotate about its longitudinal axis $A_{52}$, with engagement between the extension 88 and the circumferentially spaced apart edges 52C-1, 52C-2 of the aperture 52C limiting the amount of rotation of the shaft 52. Preferably, the shaft 52 may rotate from about +/−18 degrees from a neutral position (0 degrees). In further examples, it is contemplated that the shaft 52 could rotate beyond +/−18 degrees.

In other embodiments (not shown) in which the shaft 52 comprise the extension and the interior surface 40C of the body 40 comprises a recess, an inner dimension of the recess may be configured to similarly limit an extent of rotational motion of the shaft 52 relative to the body 40. In further examples (not shown), the body 40 and/or shaft 52 may comprise one or more additional structures (other than the structure(s) that retain the shaft 52 within the body 40) that limit rotational movement of the portion(s) of the forward assembly 50 relative to the body 40. For instance, in examples in which the shaft 52 receives the horseshoe-shaped element (not shown) described above, the body 40 may comprise an additional groove or ledge that engages the horseshoe-shaped element to limit rotation of the shaft 52.

In all embodiments, during assembly, the shaft 52 comprising the one or more structures may pass through the open end 40A of the body 40 formed by the substantially continuous band of material 90. When the shaft 52 comprises the aperture 52C and the interior surface 40C of the body 40, i.e., the bottom shell 44, comprises the extension 88 as shown in FIGS. 6, 7, and 8B, the outer diameter of the rear end 52B of the shaft 52 may be configured to be only slightly smaller than the inner diameter of the opening 90A defined by the substantially continuous band of material 90. Because the extension is not on the shaft 52, the inner diameter of the opening 90A does not need to be made larger to accommodate the extension. In other words, the opening 90A may be only slightly larger than the outer diameter of the rear end 52B of the shaft 52, which allows for a more stable connection of the forward assembly 50 to the body 40, thereby reducing or substantially preventing wobble or side-to-side movement of the forward assembly 50 relative to the body 40. When the shaft 52 comprises the extension (not shown), the inner diameter of the opening 90A defined by the substantially continuous band of material 90 and the outer diameter of the rear end 52B of the shaft 52 may be substantially as described above, except that the opening 90A may comprise a small notch (not shown; extends partially through the substantially continuous band of material 90) sized to allow the shaft 52 with the extension to pass through the opening 90A during assembly of the handle 12. Although not visible, the substantially continuous band of material 90' of the handle 12' depicted in FIG. 9 may similarly comprise an opening with an inner diameter that is only slightly larger than the outer diameter of the rear end 52B of the shaft 52.

By forming the open end of the body from the substantially continuous band of material as described herein, a bending strength of the razor handle formed from the body may be increased. Razor handles are subjected to a variety of forces in everyday use, including bending and impact forces. For example, during shaving and cartridge replacement, the user typically holds one end of the handle rigid and places the other end under a load, e.g., by pressing the cartridge against a surface to be shaved, pushing the button to eject an old cartridge, and/or pressing a new cartridge onto the handle. In addition, the razor handle may be subjected to impact and bending forces when it is, for example, dropped, packed tightly in a travel bag and pressed against other objects, etc. Many razor handles are formed from plastic and comprise a two-piece construction in which the top and bottom halves are joined, at least in part, using ultrasonic welding. A forward portion of a joint between the top and bottom halves is often positioned near a location of stress concentration, such as a point of rotation or a geometric discontinuity in the razor handle (e.g., a portion that is offset relative to the major longitudinal axis of the razor handle). When the razor handle is subjected to bending forces, this forward portion of the joint may break, as the individual welds may be relatively weak, and the two halves may begin separating along the remainder of the joint. Separation of the two halves compromises the bending strength of the razor handle, and in some cases, one or both of the halves may also begin to crack in a direction perpendicular to the longitudinal axis of the razor handle. The razor handle may continue to function as intended for a time without the user noticing an appreciable change in operation, but the amount of separation between the two halves and/or the decrease in bending strength may eventually become significant enough that the razor handle loses its ability to function and/or the user becomes dissatisfied with the feel of the razor handle. In addition, in razor handles with rotating components, even a small amount of separation between the two halves may allow one or more of the rotating components to dislodge, which may result in a loss of the rotating function and/or detachment of the rotating components from the razor handle.

It is believed that razor handles in accordance with the present disclosure will provide improved bending strength and may help to avoid separation of the top and bottom shells. When the second end of the razor handle is held rigid and the razor handle is subjected to a bending force (e.g., by exerting an upward force on the forward assembly), an area of highest stress concentration occurs near the substantially continuous band of material. This area is formed from a continuous or substantially continuous piece of material, such that the bending strength of the razor handle may be limited primarily by the properties of the material comprising the substantially continuous band of material, as opposed to being limited by the strength of the joint between the top and bottom shells. The forward joint between the top and bottom shells is spaced away from this area of stress concentration, which reduces the likelihood that the top and bottoms shells will separate.

In embodiments in which the top and bottom shells are joined along their inner edges, wherein the inner edges are defined by curved connecting portions and an intermediate portion extending between corresponding pairs of the connecting portions, a force exerted on the forward portion of the joint between the top and bottom shells will generally be distributed more evenly and over a larger area. This structure in which connecting portions with a curved or arched shape are joined by an intermediate portion demonstrates much greater mechanical strength when subjected to a bending force, as compared to a joint between inner edges having substantially linearly shaped portions that extend substantially the entire extent of the top and bottom shells from a rear portion to a forward open portion. The arched shape causes the force to be distributed along the curve of the arch, rather than concentrating in one small area. In addition, razor handles in accordance with the present disclosure may use a two-piece construction that may take advantage of the benefits of molding, while still maintaining the structural integrity of the razor handle. In particular, a thickness of the material forming the top and bottom shells may be minimized to retain a particular aesthetic look and feel for the razor handle. Forming the razor handle via molding also allows the formation of one or more hollow cavities to accommodate, for example, the metal rod and of one or more structures on the inner surface(s) of the top and/or bottom shells that securely retain the rotating components within the razor handle.

Formation of the open end of the razor handle by the substantially continuous band of material further allows tight control of the inner diameter of the opening. In razor handles in which the open end is formed by two halves, the inner diameter of the opening may vary widely depending on manufacturing tolerances, which may allow unwanted motion of any components that are received in the open end. The open end of razor handles in accordance with the present disclosure is contained entirely within one of the top shell or the bottom shell and may thus be more precisely formed during manufacture. This more exact control of dimensional variations may help to reduce the amount of wobble and other unwanted motion of the forward assembly and may provide a more robust handle. In addition, because of this more precise control, the interior surface of the substantially continuous band of material may define one of the circumferential bearing surfaces for the shaft.

Representative embodiments of the present disclosure described above can be described as follows:

A. A shaving razor handle comprising: a body defined by a top shell joined to a bottom shell, the body comprising an open end, wherein one of the top shell or the bottom shell comprises a substantially continuous band of material that forms the open end of the body.

B. The shaving razor handle of paragraph A, further comprising a handle-engaging assembly received in the open end of the body.

C. The shaving razor handle of paragraph B, further comprising a cartridge-connecting assembly coupled to the handle-engaging assembly via a connecting portion, wherein a forward end of the cartridge-connecting assembly releasably receives a replaceable cartridge.

D. The shaving razor handle of paragraph C, wherein the cartridge-connecting assembly and the connecting portion are coupled together to form a head assembly, the head assembly rotating relative to the body.

E. The shaving razor handle of paragraph C or D, wherein a section of the connecting portion is offset relative to a longitudinal axis of the body.

F. The shaving razor handle of any of paragraphs C to E, wherein a forward end of the substantially continuous band of material is closer to a joint between the top shell and the bottom shell than to the cartridge-connecting assembly.

G. The shaving razor handle of paragraph B, wherein one or more components of the handle-engaging assembly extend past a joint between the top shell and the bottom shell in a direction toward a second end of the body.

H. The shaving razor handle of any of paragraphs A to G, wherein the substantially continuous band of material is adjacent to a joint between the top shell and the bottom shell.

I. The shaving razor handle of any of paragraphs A-H, wherein the top shell comprises the substantially continuous band of material.

J. The shaving razor handle of paragraph I, wherein an inner edge of the top shell comprises:

- a substantially linear portion extending substantially parallel to a longitudinal axis of the body; and
- a curved portion extending between the substantially linear portion and the substantially continuous band of material.

K. The shaving razor handle of any of paragraphs A-H, wherein the bottom shell comprises the substantially continuous band of material.

L. The shaving razor handle of paragraph K, wherein an inner edge of the bottom shell comprises:

- a substantially linear portion extending substantially parallel to a longitudinal axis of the body; and
- a curved portion extending between the substantially linear portion and the substantially continuous band of material.

M. A shaving razor handle comprising:

- a body defined by a top shell joined to a bottom shell, the body comprising an open end, wherein one of the top shell or the bottom shell comprises a substantially continuous band of material that forms the open end of the body; and
- a forward assembly coupled to the body, wherein at least a portion of the forward assembly rotates relative to the body.

N. The shaving razor handle of paragraph M, wherein the forward assembly comprises:

- a handle-engaging assembly coupled to and received in the open end of the body; and
- a head assembly coupled to the handle-engaging assembly, the head assembly rotating relative to the body.

O. The shaving razor handle of paragraph N, wherein one or more components of the handle-engaging assembly extend past a joint between the top shell and the bottom shell in a direction toward a second end of the body.

P. The shaving razor handle of paragraph N or O, wherein the head assembly comprises a connecting portion and a cartridge-connecting assembly, the connecting portion being coupled at a forward end to the cartridge-connecting assembly and at a rear end to the handle-engaging assembly.

Q. The shaving razor handle of paragraph P, wherein a forward end of the substantially continuous band of material is closer to a joint between the top shell and the bottom shell than to the cartridge-connecting assembly.

R. The shaving razor handle of paragraph P or Q, wherein a section of the connecting portion is offset relative to a longitudinal axis of the body.

S. The shaving razor handle of any of paragraphs M to R, wherein an inner edge of the one of the top shell or the bottom shell comprises:

a substantially linear portion extending substantially parallel to a longitudinal axis of the body; and a curved portion extending between the substantially linear portion and the substantially continuous band of material.

T. A shaving razor handle comprising:

a top shell and a bottom shell joined to the top shell to define a body, wherein one of the top shell or the bottom shell comprises a substantially continuous band of material that forms an open end of the body, and wherein an inner edge of the one of the top shell or the bottom shell comprises:

a substantially linear portion extending substantially parallel to a longitudinal axis of the body; and a curved portion extending between the substantially linear portion and the substantially continuous band of material.

U. The shaving razor handle of paragraph T, wherein the body is generally straight.

V. The shaving razor handle of paragraph T or U, further comprising: a forward assembly coupled to the body, wherein at least a portion of the forward assembly rotates relative to the body.

W. The shaving razor handle of any of paragraphs T to V, wherein the substantially linear portion of the inner edge comprises a first substantially linear portion of the inner edge and the curved portion of the inner edge comprises a first curved portion of the inner edge, further comprising:

a second substantially linear portion extending substantially parallel to the longitudinal axis of the body;

a second curved portion extending between the substantially linear portion and the substantially continuous band of material; and an intermediate portion extending between and connecting the first curved portion with the second curved portion, the intermediate portion comprising at least a portion of the substantially continuous band of material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor handle comprising:

a body defined by a top shell joined to a bottom shell, the body comprising an open end, wherein one of the top shell or the bottom shell comprises a substantially continuous band of material that forms the open end of the body; and a handle-engaging assembly received in the open end of the body, wherein one or more components of the handle-engaging assembly extend past a joint between the top shell and the bottom shell in a direction toward a second end of the body.

2. The shaving razor handle of claim 1, further comprising a cartridge-connecting assembly coupled to the handle-engaging assembly via a connecting portion, wherein a forward end of the cartridge-connecting assembly releasably receives a replaceable cartridge.

3. The shaving razor handle of claim 2, wherein the cartridge-connecting assembly and the connecting portion are coupled together to form a head assembly, the head assembly rotating relative to the body.

4. The shaving razor handle of claim 2, wherein a section of the connecting portion is offset relative to a longitudinal axis of the body.

5. The shaving razor handle of claim 2, wherein a forward end of the substantially continuous band of material is closer to a joint between the top shell and the bottom shell than to the cartridge-connecting assembly.

6. The shaving razor handle of claim 1, wherein the substantially continuous band of material is adjacent to a joint between the top shell and the bottom shell.

7. The shaving razor handle of claim 1, wherein the top shell comprises the substantially continuous band of material.

8. The shaving razor handle of claim 7, wherein an inner edge of the top shell comprises:

a substantially linear portion extending substantially parallel to a longitudinal axis of the body; and a curved portion extending between the substantially linear portion and the substantially continuous band of material.

9. The shaving razor handle of claim 1, wherein the bottom shell comprises the substantially continuous band of material.

10. The shaving razor handle of claim 9, wherein an inner edge of the bottom shell comprises:

a substantially linear portion extending substantially parallel to a longitudinal axis of the body; and a curved portion extending between the substantially linear portion and the substantially continuous band of material.

11. A shaving razor handle comprising:

a body defined by a top shell joined to a bottom shell, the body comprising an open end, wherein one of the top shell or the bottom shell comprises a substantially continuous band of material that forms the open end of the body; and a forward assembly coupled to the body, wherein at least a portion of the forward assembly rotates relative to the body.

12. The shaving razor handle of claim 11, wherein the forward assembly comprises:

a handle-engaging assembly coupled to and received in the open end of the body; and a head assembly coupled to the handle-engaging assembly, the head assembly rotating relative to the body.

13. The shaving razor handle of claim 12, wherein one or more components of the handle-engaging assembly extend past a joint between the top shell and the bottom shell in a direction toward a second end of the body.

14. The shaving razor handle of claim 12, wherein the head assembly comprises a connecting portion and a cartridge-connecting assembly, the connecting portion being coupled at a forward end to the cartridge-connecting assembly and at a rear end to the handle-engaging assembly.

15. The shaving razor handle of claim 14, wherein a forward end of the substantially continuous band of material is closer to a joint between the top shell and the bottom shell than to the cartridge-connecting assembly.

16. The shaving razor handle of claim 14, wherein a section of the connecting portion is offset relative to a longitudinal axis of the body.

17. The shaving razor handle of claim 11, wherein an inner edge of the one of the top shell or the bottom shell comprises:

a substantially linear portion extending substantially parallel to a longitudinal axis of the body; and a curved portion extending between the substantially linear portion and the substantially continuous band of material.

18. A shaving razor handle comprising:

a top shell and a bottom shell joined to the top shell to define a body, wherein one of the top shell or the bottom shell comprises a substantially continuous band of material that forms an open end of the body, and wherein an inner edge of the one of the top shell or the bottom shell comprises:

a substantially linear portion extending substantially parallel to a longitudinal axis of the body;

a curved portion extending between the substantially linear portion and the substantially continuous band of material; and a forward assembly coupled to the body, wherein at least a portion of the forward assembly rotates relative to the body.

19. The shaving razor handle of claim 18, wherein the body is generally straight.

20. The shaving razor handle of claim 18, wherein the substantially linear portion of the inner edge comprises a first substantially linear portion of the inner edge and the curved portion of the inner edge comprises a first curved portion of the inner edge, further comprising:

a second substantially linear portion extending substantially parallel to the longitudinal axis of the body;

a second curved portion extending between the substantially linear portion and the substantially continuous band of material; and an intermediate portion extending between and connecting the first curved portion with the second curved portion, the intermediate portion comprising at least a portion of the substantially continuous band of material.

* * * * *